United States Patent [19]

Goldfarb et al.

[11] Patent Number: 5,050,883

[45] Date of Patent: Sep. 24, 1991

[54] SELF-CONTAINED COMPETITIVE GAME FOR DEVELOPING SPATIAL SENSE IN YOUNG CHILDREN

[75] Inventors: Adolph E. Goldfarb, Westlake; Martin I. Goldfarb, Santa Monica, both of Calif.

[73] Assignee: Adolph E. Goldfarb, Los Angeles, Calif.

[21] Appl. No.: 476,748

[22] Filed: Feb. 7, 1990

[51] Int. Cl.[5] ..... A63F 9/06; A63F 3/00

[52] U.S. Cl. ..... 273/153 R; 273/236; 273/237; 273/85 G; 273/251; 273/252; 273/258; 273/454

[58] Field of Search ..... 273/238, 237, 1 E, 138 A, 273/254, 153 R, 1 GC, 85 G, 251, 252, 258, 262

[56] References Cited

U.S. PATENT DOCUMENTS

| | | | |
|---|---|---|---|
| 4,182,514 | 1/1980 | Magid et al. | 273/237 |
| 4,240.638 | 12/1980 | Morrison et al. | 273/237 |
| 4,323,242 | 4/1982 | Rosenfeld | 273/153 R |
| 4,326,719 | 4/1982 | Tran et al. | 273/238 |

FOREIGN PATENT DOCUMENTS

| | | | |
|---|---|---|---|
| 2040172 | 8/1980 | United Kingdom | 273/153 R |

*Primary Examiner*—Edward M. Coven

*Assistant Examiner*—Junhee Lee

*Attorney, Agent, or Firm*—Ashen Martin Seldon Lippman & Scillieri

[57] ABSTRACT

Electronics and a playing method stimulate abstract spatil-relations ability, particularly memory of abstract space, in youngsters—without requiring them to know or spell game commands, or to find keys on a typewriter-like keyboard. The game exploits the competitive instinct by rewarding ability to recall complex geometric abstractions, while yet encouraging play by those who lack that ability. Dedicated manual inputs are used by each player to enter moves—in the pure form of directions in which the player wishes to go. An audio speaker signals which player's move it is, and whether each attempted move is valid. A digital microprocessor is used to define a maze and each player's position in it, and to receive moves from the directional inputs, and to operate the speaker in reply to attempted moves. The processor has no functional connection with any device for displaying a direct pictorial representation of any part of the maze, and indeed no such direct picture is electronically developed or shown. The game does include, however, a playing board on which players can in effect map their own attempts to move through part of the maze—if they are willing to let other players see their maps.

13 Claims, 4 Drawing Sheets

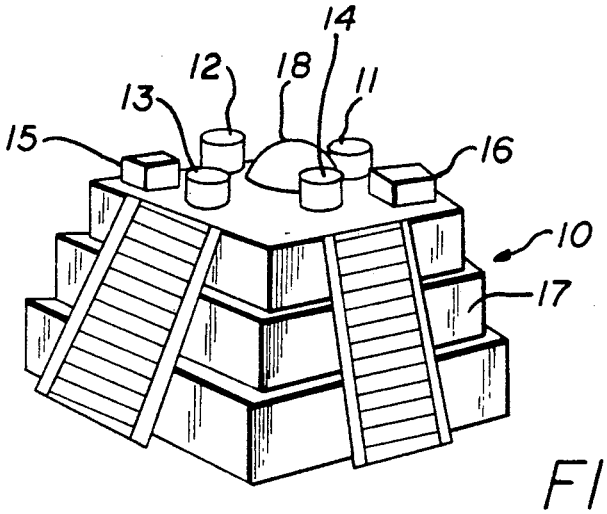
FIG. 1
FIG. 2
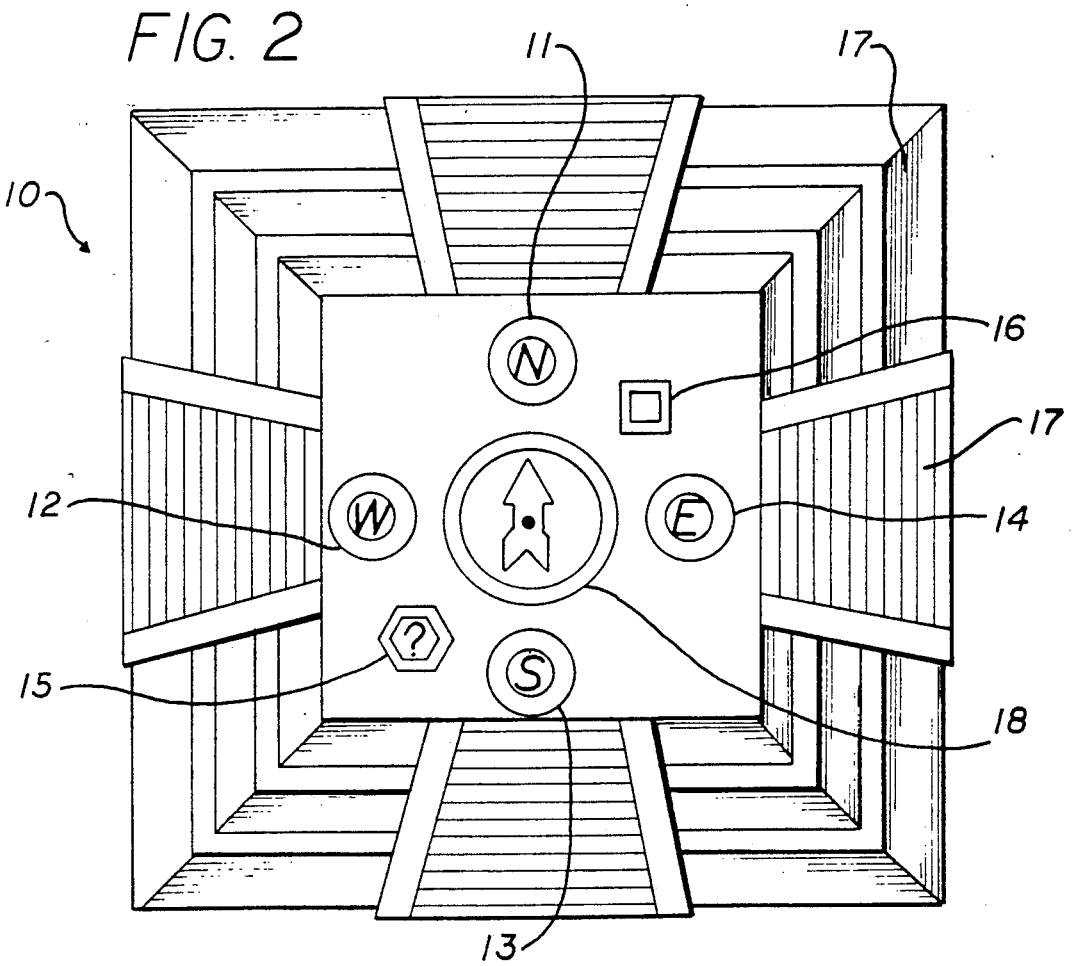

SELF-CONTAINED COMPETITIVE GAME FOR DEVELOPING SPATIAL SENSE IN YOUNG CHILDREN

BACKGROUND

1. Field of the Invention

This invention relates generally to inexpensive dedicated electronic games for stimulating and developing mental skills in young children—down to age 7 or 8; and more particularly to such a game that encourages purely spatial-relations capabilities by providing game incentives for successful game moves in an invisible, abstract space.

By "inexpensive dedicated electronic games" we mean to contrast the field of our invention with the field of far more expensive cartridge-type game computers, and also with the field of games based on general-purpose computers that have typewriter-style keyboards.

2. Prior Art

Dozens or possibly hundreds of electronic games have been introduced that accept input information from solely directional input devices such as joysticks or small arrays of pushbuttons. Many or all of these games involve electronically displayed pictures of playing fields, maps or mazes, and many are competitive games in which two or more players participate simultaneously or by turns.

In each of such games the pictorial display generally includes an electronically generated image of at least one figurine or other playing token. The associated directional input device controls the position at which the token appears in the display.

Other types of microprocessor-based activities also have employed directional input devices—including so-called "mice" as well as joysticks and pushbuttons. For example, some very commonly known word-processing programs, spreadsheet programs, and the like, use such input mechanisms for conveying information to computers about screen positions where changes are to be made. In other common programs, directional input devices are used in selection of so-called "icons" to convey information about categories of actions to be performed, etc. In each of these serious applications a simple cursor usually replaces a game token.

In essentially every one of such computer applications, including games, the results of directional input manipulations appear on a more-or-less continuous basis in the pictorial display. The movement of the token or cursor provides visual feedback to the operator.

In such a game the operator usually performs, in effect, as part of a feedback loop to accelerate or decelerate the movement as desired to quickly (but preferably without overshooting) position the token or cursor as desired.

It will be appreciated that such a function on the part of the operator—the player, in the case of a game—may enhance motor skills, coordination, and reflexes. The very point of such a game, however, is to create an artificial visible environment for the exercise of such physical skills, leaving little or nothing to the imagination; and certainly requiring little in the way of powers of visualization.

Accordingly such games may be regarded as representing microprocessor-based activity of one extreme type in which imagination and visualization are minimized while manual dexterity, physical alertness, and quickness of response are brought to the fore.

At another extreme are numerous known computer-based text games, in which only words are displayed. In each such game, words are combined in sentences or sentence fragments to describe an invisible environment through which a player may progress.

(To play these games, a player loads software into a general-purpose personal computer. These games accordingly are outside the field of the present invention, which encompasses only dedicated-electronics games. Text games are discussed here, however, for completeness.)

The player's responses too are verbal—again, sentences or fragments typewritten by the player at the computer keyboard. Thus the computer may display narrative such as "You have entered a room in which there is a ball and a doorway". The player may respond, "Pick up the ball" or "What color is the doorway?"

The computer is programmed to interpret such entries and reply appropriately—even to the extent of controlling progress through the artificial environment verbally described. Implicitly embedded in the computer narrative, in fact, is an enormously complex maze in three (or more) dimensions, as well as extremely complex game protocols.

The maze is not only geometrical, but also interpersonal, in the sense that the player must confront and/or employ many kinds of personalities along the fantasy route to a goal. Often success in reaching the goal depends upon backtracking from a cul de sac, or from a segment of the maze in which adverse events occur.

Such a game both relies heavily upon and also stimulates and develops two distinct groups of capabilities or talents on the part of the player. One of these talents is spatial-relations sense. It includes the ability to visualize the immediate but invisible scene, and the ability to recall all the twists and turns (geometrical and otherwise) previously visualized along the imaginary route; together with the ability to relate the present and the earlier visualizations.

The other of the required talents is verbal ability, including the capabilities to read and understand the narrative, and to develop and type suitable verbal responses. In text games, the verbal ability forms a threshold to stimulation and exercise of the spatial-relations ability.

That is to say, the game is not accessible to would-be players who cannot, at least at some minimal functioning level, read and write. By "write" of course we mean spell, and find keys on a typewriter-style keyboard.

Down to a certain level, such games can be used by children who are willing to enter commands at the keyboard by a laborious, hunt-and-peck process. Such a process can become so laborious, however, that it interferes with the ability to imagine the maze, or with the sensation of continuity of progress through the imagined maze.

At that point, access to such games is effectively foreclosed. Thus for very young children, and also for older children whose verbal abilities are for any reason badly suppressed, access is denied to the stimulation and development of the spatial-relations abilities discussed above.

All the text games, to the best of our knowledge, are single-player pastimes. They lack provision for taking turns, competitive scorekeeping, and other mechanisms that enlist peer pressure in aid of skill development.

Intermediate between the directional-input games with pictorial playing fields, at one extreme, and the text games with invisible playing environments at the other extreme are various other electronic games—such as, for example, the games distributed under the registered trademarks Wizardry, Ultima, and Dungeons & Dragons. Like the text games, these are based upon general-purpose computers, and so are outside the field of the present invention.

Each of these games is "intermediate" in that it generally displays a partial picture of a maze (usually an extremely elaborate multidimensional one) together with a small amount of related narrative or instructions—in effect, the electronic equivalent of a comic-book frame. The player generally enters coded responses at a standard typewriter-style keyboard.

In other words, a player looks at the computer screen and sees a picture, usually in a cartoon representation, of part of his game environment. For example, the screen may show a hallway, extending forward and possibly downward.

During the game the player has or acquires (or both) certain playing characters which serve as game tokens—but they are extremely elaborate tokens. Each usually possesses a complex of abilities and other properties that interact with those of other characters and with the properties of the game environment.

A player's characters are controlled by commands entered at the keyboard. Along the way other characters usually appear, either adversarial or friendly, controlled primarily by the software (although actually, as will be understood, their behavior too is usually responsive to player commands).

These games place a premium on the player's ability to remember enormous amounts of detail that have previously been displayed and traversed. Details to be remembered include not only the geometric twists and turns of the maze, but events and characters that have been acquired or met at various points.

As a general matter, however, the structure of each portion of the maze need not be visualized when first encountered. Unlike the text games, these games reveal the structure pictorially in incremental fashion, by means of the direct views displayed upon the screen.

Walls in most of these games appear to have grids on them, to accentuate the wall contours and the presence of connecting passages. Hallways and rooms are typically many grid units wide.

Hence as a general matter these games show in a direct pictorial way what the playing environment is. It must be noted, however, that these games frequently include special elements that cannot be seen in the pictures.

For instance, secret doors are sometimes provided in the walls (and trapdoors in the floors or ceilings). A player can direct one of the player's keyboard-controlled characters to simply turn and attempt to walk through a secret door.

The player will then find—if a door is in fact present next to the character—that the character has passed through the wall into a secret side passage, which then can be seen on the screen. If no door is present, the computer will respond with a textual, acoustic or pictorial indication that an impossible maneuver has been attempted; and the previous scene will persist.

Analogously, these games sometimes incorporate special so-called "magical" or "scientific" devices that provide abrupt transitions between locations in the maze. Such a device may, for example, be termed a "transporter"; and a player who has access to such a device may, for example, be allowed to move from a present location to a preferred one.

Similarly, in some of these games the fantasy protocols include availability of a "torch" to light the way, or a "light spell" (in the games that emphasize the nomenclature of magic). The torch or light spell allows a player to "see" the tunnel or other pathway—this is, to say, the immediate scene appears on the screen.

In games that have these features, a player can for strategic reasons undertake to traverse part of the maze without such a spell or torch. Under such special circumstances the pictorial part of the screen display is absent. This mode of play, however, is exceptional and almost always very limited; a usual and early object of the game is to obtain and carry light.

Variants of the Wizardry type of game include several games (including one known by the trade name Rogue) in which there is nothing to see until the player attempts to move. If the move is valid, then a simple graphic—representing halls, rooms, etc—begins to cumulatively develop on the screen. Only the portions already traversed are shown; but the computer performs the process of displaying and cumulating the map.

Again, all these game-play portions or variants that employ maze-element invisibility are very limited in duration or degree, or both. They are included here only for completeness.

The player's keyboard-controlled characters that appear in these games are all cooperative, as distinguished from adversarial. Further, in some of these games two or more players can participate, but they do so by taking control of respective keyboard-controlled characters in a cooperative or teamwork mode of play. Hence these games, like the text games, are not competitive.

One other type of prior game shold be mentioned, although it was entirely outside the field of electronic games (not to mention dedicated electronic games). The object of that games was to elicit successful game moves in an invisible maze—and therefore in a space that could be called effectively abstract.

The game consisted of a physically molded miniature maze, formed inside a box. The box has an opaque cover, preventing a player from seeing the maze structure; a small ball was inserted into the maze at a starting position.

The person playing the game would hold and manipulate the entire box in an attempt to move the ball to a finish position. The player's main clue to progress of the ball through the maze—and to the structure of the maze, for that matter—was the sound of the ball hitting the wall of the maze.

Successful play of the game required an ability to visualize parts of the maze from the auditory clues, and to recall information gleaned about the maze structure in earlier efforts.

That game, however, provided no way for a person with developing spatial sense to reinforce and encourage that developing ability by creating a partial visible map of the maze during progress of the game. It also required some manual dexterity and some hand-ear coordination of an unusual sort; these capabilities are often lacking in younger children, once again forming a discouraging barrier to fullest use of the game in developing spatial-relations sense.

Thus, without in the least detracting from the efficacy of all the above-discussed games for their own purposes, it is fair to generalize as follows. Those pior electronic games that accept purely directional inputs, and therefore are accessible to very young children, exercise only motor skills and only in a visible environment.

On the other hand, those prior electronic games that do exercise spatial-relations sense—particularly visualization and recall of unseen geometric abstraction—are inaccessible to most children of age 7 or 8, because of demands placed upon verbal and typing ability, and also in most cases because of very high levels of complexity, and finally because they fail to make direct use of the competitive incentive.

This inaccessibility is most emphatically true for text games, which most fully implicate the player's capacity to visualize unseen abstraction. It is even true, however, of the Wizardry-style and Rogue-style games that dilute the visualization demands by displaying portions of the playing environment pictorially.

Furthermore, we are not aware of any suggestion in the prior art that the visible-maze joystick games might be in any way modified for use in developing spatial-relations sense; or that the enormously complex text games, or Wizardry/Rogue games, might be in any way modified for use by very young children who lack verbal and typing abilities.

As to the mechanical maze-in-a-box game, we are not aware of any suggestions that it might be implemented in any electronic form; or that it might be enhanced by provision of a cumulative mapping function, or that its requirements of dexterity or coordination might be reduced to make it more usuable by younger children.

SUMMARY OF THE DISCLOSURE

The present invention provides a self-contained electronic game for stimulating and developing abstract spatial-relations sense in young children—without requiring verbal or spelling ability, or the ability to operate a typewriter-like keyboard. The invention also provides a method of play for a game that stimulates and develops such spatial-relations sense.

We shall describe the electronic game first. It includes first dedicated digital electronic memory means defining a maze; and second dedicated digital electronic memory means defining a position in the maze for each player of the game respectively.

In the detailed-description section of this document we shall state what we mean by "defining a maze." This can be done electronically in a great variety of ways, all of which we believe are within the scope of our invention.

Our electronic game also includes manually operable dedicated directional input means for use by a player in entering an attempted move; and dedicated annunciator means for communicating to players whether an attempted move is valid.

The game also includes dedicated digital electronic processing means for responding to any attempted move which each player respectively enters at the input means. The processing means perform this "responding" function by actuating the annunciator means to communicate whether that move is valid for that player's position in the maze.

The processing means are interconnected to receive information from the directional input means and from the first and second memory means. The processing means have no functional interconnection, however, with any device for displaying a direct pictorial representation of any portion of the maze.

The foregoing may be a definition of the electronic game of our invention in its broadest or most general form. From this broad definition it is already possible to see that this game deals purely in a mentally visualized spatial-relations environment, without the encumbrances of coping with a typewriter keyboard, or learning verbal commands or the correct spelling of such commands—and without the far greater expense of either a general-purpose computer or a game computer.

Consequently our invention, even in its most general form described so far, successfully addresses the development of spatial-relations capacity in very young children, whereas prior electronic games have not done so.

We prefer, however, to practice our invention with certain additional features or characteristics that enhance the results and provide for fullest enjoyment of its advantages.

For example, we prefer that the directional input means include means for receiving the direction of the attempted move from a single respective manual motion. This preferred feature maximizes the ease with which very young players can interact with the electronic processor in a purely geometric communication mode.

We also prefer that the game include passive pictorial means for pictorially representing an array of game positions. These pictorially represented positions correspond conceptually to an abstract array of geometric positions that include the geometric positions constituting the maze. These passive pictorial means, however, have no electronic interconnection with the processing means.

In this preferred form of the game we also prefer to have position-defining means, for manual placement in relation to the pictorial means—to aid a player in visualizing position in and progress through the game positions.

By way of example, the "passive pictorial means" mentioned above may advantageously take the form of a game board. The position-defining means may advantageously take the form of playing tokens for manual placement on the game board.

Preferably, but not necessarily, the passive pictorial means include first directional indicia, which define orientation in relation to the array of game positions; while the input means include a control housing having second directional indicia, which are related to the first directional indicia.

In a game which has these preferred features, the input-means control housing is susceptible to alignment with the passive pictorial means. This provides a natural way for the players to form a mental link between directions within the passive pictorial means and respective directional inputs on the control housing.

Turning now to the game-playing method of our invention, it includes the steps of:

(a) entering an attempted game move into a dedicated digital electronic device that has a stored digital representation of a maze, and of at least one player position on the maze;

(b) then receiving from the device information solely as to validity of the attempted move;

(c) then visualizing, exclusively by inference from the validity information cumulatively received, part of the configuration of the maze; and (d) repeating steps (a) through (c), in the same order, multiple times to advance through the maze to a goal.

This method has no step in which the electronic device during normal play develops or displays a direct visual representation of any portion of the maze.

As is the case with the electronic game of our invention, we prefer to practice this method with various additional steps or characteristics that enhance its benefits.

For example, we prefer that the visualizing step optionally include using a passive pictorial game board or the like to manually keep track of the visualized part of the maze configuration. As before, the board preferably defines a multiplicity of game positions, but is not interconnected with the electronic device electronically to display any direct visual representation of the maze.

We also prefer that the game-playing method include the additional step of, before the first performance of the entering step, aligning indicia on the electronic device with corresponding indicia on the game board.

As mentioned above in regard to the electronic game, the method of our invention has the advantage of providing a way to aid in developing spatial-relations capacities in very young children.

All of the foregoing operational principles and advantages of the present invention will be more fully appreciated upon consideration of the following detailed description, with reference to the appended drawings, of which:

BRIEF DESCRIPTION OF THE DRAWINGS

FIG. 1 is a perspective or isometric view of an electronic-device housing, in a preferred embodiment of our invention;

FIG. 2 is a more detailed plan view of directional inputs, and other controls, mounted in the FIG. 1 electronic-device housing;

DETAILED DESCRIPTION OF THE PREFERRED EMBODIMENTS

Figure 3:
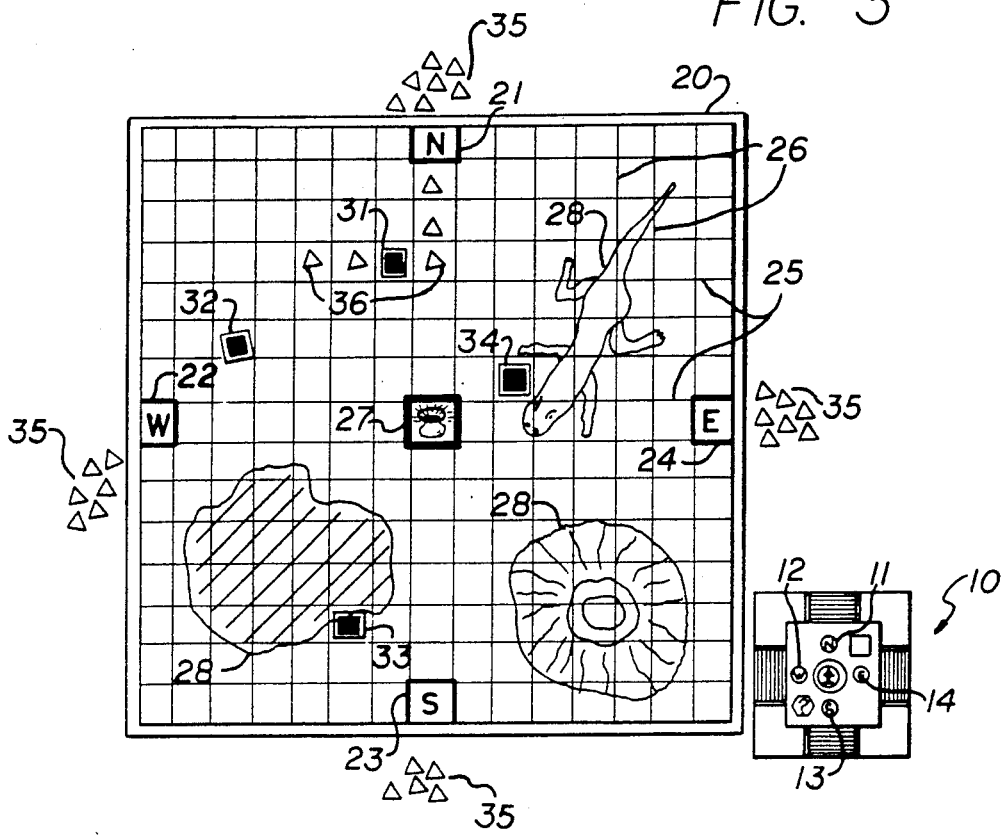
FIG. 3 is a plan view of the FIG. 1 electronic-device housing, together with a game board.

As shown in FIGS. 1 and 2, a preferred embodiment of our invention includes an electronic-device housing 10, to which are prominently mounted directional-input pushbuttons 11, 12, 13 and 14. These manually operated input devices have associated customary directional indicia such as the letters "N", "W", "S" and "E" respectively.

As will be appreciated the directional indicia can be adjacent to, rather than directly upon (as illustrated), the pushbuttons; and other mutually distinct indicia—such as different pushbutton shapes or colors, or associated patterns—may be substituted for the letters shown. Furthermore, other modes of directionality entirely, such as for instance input devices based upon polar coordinates, may be substituted.

Other input devices, such as pushbuttons 15 and 16 are also mounted to the housing 10. Of these, one pushbutton 15 is advantageously provided for use by the players in querying the electronic device to determine which of several possible mazes is in use.

Such an additional input device 15 may accordingly have an associated indicium such as the question mark "?"—which is particularly suitable if the device is to be used by very young children who are not facile with the reading of words. If preferred, however, a more elaborate indicium such as "MAZE NUMBER" may be substituted.

The other additional input device 16 is preferably provided for use by the players in turning the electronic device on. Any suitable indicium such as a picture of an open eye, or a small line drawing of a person awakening, etc., may be associated with this additional pushbutton 16.

As illustrated, all these input devices are mounted to the housing 10 for ready access by players. The four directional input pushbuttons ideally are mounted in a mutual geometric relationship that strongly suggest the relative directionality which those four buttons possess functionally—as will be explained.

The housing 10 itself preferably has some thematic shape and exterior ornamentation 17 that are coordinated with esthetic elements of a game board to be described below, and accordingly with a story theme or the like that is aimed at enhancing the appeal of the game for young children. For instance, as illustrated the housing 10 may be configured as an image of an ancient Inca pyramid or other such treasure-related object.

In addition the housing 10 may have additional ornamentation that connotes directionality. For example, the housing may bear a simulation of a compass 18. Advantageously, literature accompanying the game may identify the housing 10 by nomenclature such as "electronic compass" or some other such phrase that connotes directionality. To further enhance these connotations, the compass graphic 18 may be placed within a plastic bubble, as best seen in FIG. 1; however, in the preferred embodiment that we describe here, the compass face 18 is not in any way functionally operative as a compass.

The housing 10 is hollow or otherwise formed to enclose operating components of the electronic device, and particularly the components to be discussed in connection with FIG. 5. These include a microprocessor, audio speaker, signal lamp (at the center of the compass 18), at least one battery, and other electronic components—all functionally connected with the operative electrically conducting portions of the pushbutton switches 11 through 16.

As shown in FIG. 3, the character of the indicia associated with the directional-input pushbuttons 11 through 14—and also the relative positions of those four directional-input devices—are mirrored in certain graphic elements of a game board 20 that is provided for use with the electronic device 10. Other graphic elements of the board 20, however, diverge from the indicia and positions of the directional-input devices.

More specifically, the board 20 bears four directional indicia 21 through 24, which advantageously take the form of letters "N", "W", "S" and "E". These four directional indicia are printed directly onto the board; or are printed onto paper which is then glued to the board; or are otherwise caused to be carried visibly by the board. These four indicia, like the corresponding indicia 11 through 14 on the electronic device 10, are arrayed in customary relative fashion along respective opposing edges of the game board.

In the preferred embodiment that is illustrated, the electronic-device housing 10 is not connected functionally (or in fact connected at all) with the game board 20. Accordingly it is left to the players of the game, if they wish, to mutually align the housing 10 and board 20.

That is to say, the players can arrange the housing 10 so that its "north-south" axis defined by the buttons 11 and 13 is parallel and in like orientation to the corresponding axis of the board 20. It is within the scope of our invention, however, to construct the housing and board as a single integral unit, with that relative orientation thus built in; or to construct them so that they fit together in that, and only that, relative orientation.

Other indicia borne by the game board 20 include parallels (i. e., east-west lines) 25 and meridians 26, all intersecting at right angles to form a grid. This grid systematically subdivides substantially the entire face of the board 20 into small squares—fifteen across, and fifteen down.

Also on the board 20 is a prominent indicium 27 occupying the central one of these small squares. This central indicium 27 may advantageously represent any symbol that connotes a game objective or end-point, such as for example a pot of gold.

While this central indicium accordingly indicates that the central square on the board 20 is the objective of the game, in the preferred embodiment of FIG. 3 the four previously discussed directional indicia 21 through 24 are starting points for as many as four players. In other words, each player starts at one of the four directional indicia 21 through 24, and attempts to reach the central indicium 27.

In traversing the grid from one of the four starting points 21, 22, 23 or 24 to the goal 27, each player is constrained to use only certain specified square of the grid. That is to say, the players are permitted to use only certain squares, and are prohibited from using other squares.

Furthermore, even between two immediately adjacent squares that players are permitted to use, each player is constrained to use only certain specified paths or routes. In other words, some immediately adjacent squares must be interpreted as separated by walls.

In the preferred embodiment of our game that is here under discussion, nothing whatsoever on the board 20 indicates which squares of the grid are available for travel, or which are foreclosed—or which paths between adjacent squares are usable, and which are not. Those functions are performed by, exclusively, the electronic device within the housing 10—in a fashion to be described shortly.

Even before discussion of details of that function, however, one can now appreciate that the grid 25, 26 defines mmerely a space in which a maze can be defined. The maze itself—that is, the structure of permitted and prohibited occupancies and pathways—is invisible.

Also advantageously imprinted on the board are adventure-style graphics 28, which may include lakes, volcanoes, dragons, or indeed any indicia whatever—since these adventure graphics 28 have nothing in the slightest to do functionally with the mechanics of game play, but only serve to impart a theme to the game. These graphics are preferably related in some fashion with the previously mentioned thematic elements 17 of the electronic-device housing 10.

FIG. 3 also shows two groups of playing tokens, for placement by the players on or near the board 20. A first group consists of four tokens 31 through 34 for marking the current positions of the four players respectively. If fewer than four players participate, then a corresponding smaller number of these tokens 31 through 34 will be used.

The second group of tokens 35 is used to mark previous positions of the players, and so to assist the players in recalling the hallway locations or paths previously discovered. Each player may employ the tokens and path markers 31 through 35, or play without them, as preferred.

The squares that are available for travel by each player are also available for travel by each other player, although not every player will find it necessary or desirable to traverse a portion of another player's track. Hence it is possible for each player to benefit by watching the efforts of the other players, and attempting to remember the structure of permissable and prohibited paths—which is to say, the invisible structure of the maze.

A player who plays without the path markers 35 relies upon that player's own memory to map out the paths (that is, the portions of the maze) previously traversed successfully. Such a player effectively denies other players the benefit of the visual mapping.

A player who is new to the game, however, or who is rather too young to hold such information accurately for a protracted time, can generally do better by using the markers. This is particularly true if that player is competing against other players who are more experienced or older, or who otherwise have much better memories for this type of information.

On the other hand, a very advanced player may choose to play the game without using even that player's own current-position marker 31, 32, 33 or 34. This strategy would put the other players to the additional task of watching that player's operation of the directional-input pushbutton switches 11 through 14, and in that way keeping mental track of that player's progress.

Figure 4:
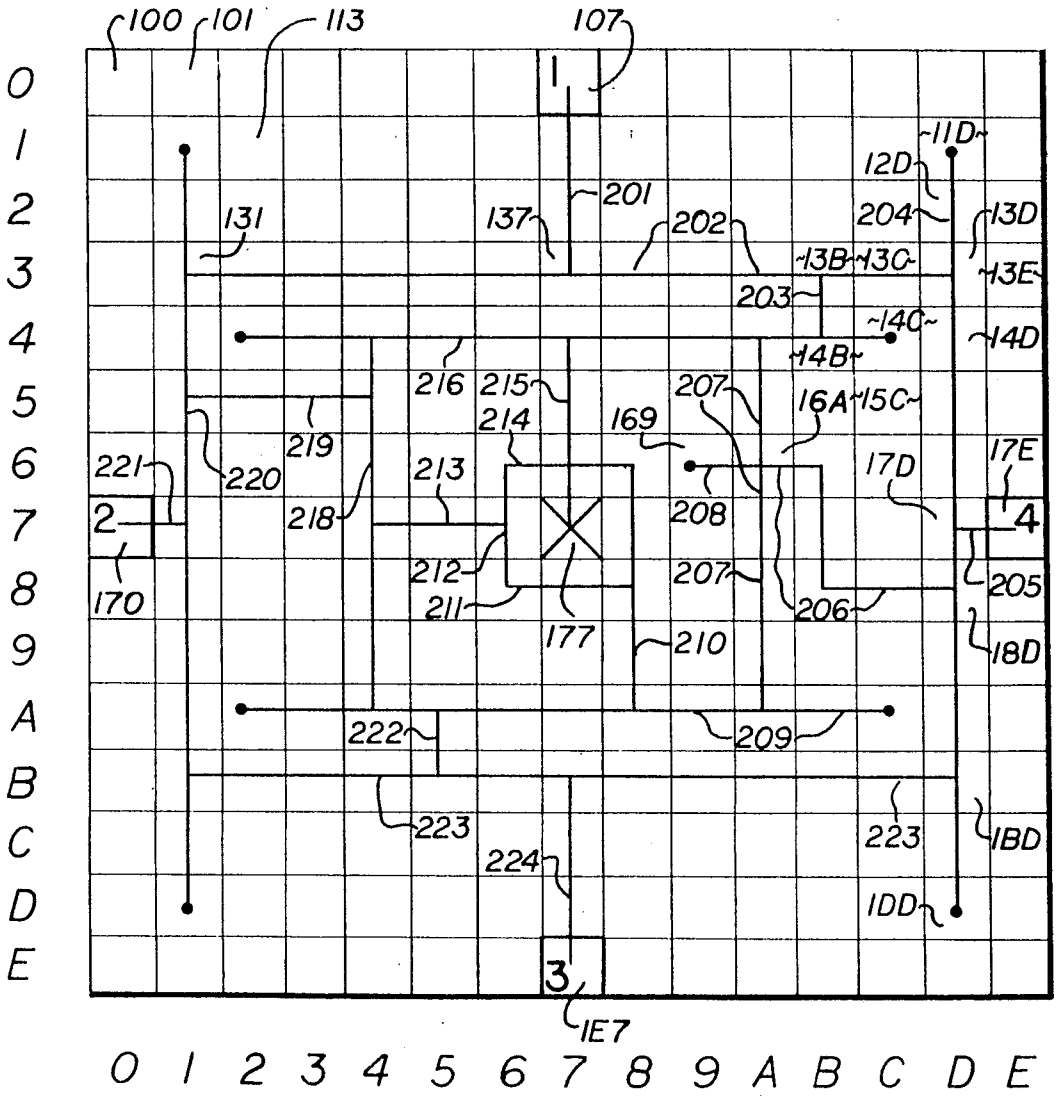
FIG. 4 is a diagram of a maze that is defined in the memory of the electronic device that is within the housing.

FIG. 4 shows, in effect, a maze that can be defined in the fifteen-by-fifteen grid on the game board 20 of FIG. 3. An alternative conceptualization is that FIG. 4 shows a maze defined in an abstract-space grid—also diagrammed in FIG. 4—that corresponds to the game-board grid.

The abstract-space grid itself has been drawn in FIG. 4 using thin or light lines. To facilitate reference by modified Cartesian coordinates, the square of the grid in FIG. 4 are identified by rank and file.

More specifically, the fifteen ranks are marked in hexadecimal notation along the left edge of FIG. 4—from 0 (zero) at the top of the diagram through E at the bottom, inclusive. The fifteen files are similarly marked along the bottom edge, from 0 at the left through E at the right.

In this text, coordinates of the various grid squares will be run together—but preceded by a number "1" to distinguish some of them from reference numerals in other drawings of this document. Thus the square in the top left corner, which in Cartesian coordinates should be square "(0,0)", will for convenience be identified in this discussion simply as square 100. The square immediately to its right, square (0,1 ) in modified Cartesian notation with the ordinate dimension or rank number preceding the abscissa dimension or file number, here is 101; the starting square (E,7) for player #3 at the "south" starting point is 1E7 (also marked "3" in FIG. 4), and so forth.

Within this abstract-space diagram of FIG. 4, bolder or heavier lines are used to define permitted transitions, or paths, between squares. It is these pathways—or, if preferred, the impassable regions that stand between the paths—that constitute the maze. All of the paths are identified in FIG. 4 by arbitrarily assigned three-digit reference numbers beginning with the prefix "2".

Thus a permitted path 201 extends from the starting point for player 1 (square 107) down three squares to meet, in square 137, another permitted path 202. The latter path 202 intersects in square 13B with vertical path 203, but also extends from an intersection in square 131 with path 220 to an intersection in square 13D with pathway 204.

Path 204 in turn extends from one cul de sac in square 11D to another cul de sac in square 1DD, along the way intersecting path 205 in square 17D, path 206 in square 18D, and path 223 in square 1BD. Path 205 is just one square long, extending only from the starting point in square 17E for player 4 westward (leftward) one square to the intersection with path 204 already described.

The central goal square 177 is accessible only via the lower one-square-long segment of path 215. As can be seen, that path extends from an intersection with a horizontal or east-west path 216 downward two squares to cross another horizontal path 214 and then enter the goal square 177. The maze in FIG. 4 is merely exemplary of a huge or infinite number of mazes that could be defined in the grid.

Now by reference to the grid and maze shown in FIG. 4, and in particular using the coordinate nomenclature established in the foregoing paragraphs, it is possible to discuss a considerable variety of ways in which such a maze can be defined within a solid-state digital electronic memory integrated circuit, or more particularly within the memory portions of a microprocessor.

One such way to define a maze is to store a list of occupiable grid positions, and with each such grid position a list of directions in which movement is permitted. This mode offers particular convenience for present purposes, since it allows direct comparison of a player's attempted movement directions with the permitted movement directions. If the attempted direction can be found in the list of permitted directions, the microprocessor can proceed to advance the player's position in the attempted direction.

For example, for square 11D the list of permitted directions consists of just one entry: "south" (that is, downward in the drawing, into square 12D). For square 13C the list has two entries: west (leftward into square 13B) and east (rightward into square 13D).

For square 13D the list has three entries: north, west, and south (for movement into squares 12D, 13C and 14D respectively). For square 16A the list has four entries, consisting of all four possible movement directions.

A second approach, almost identically equivalent to the first, is to store the same list of occupiable positions, but with a negative of the first-mentioned directional list—that is to say, for each occupiable position, a list of directions in which movement is prohibited. Here the microprocessor advances the player's position in the attempted direction only if that direction cannot be found in the list of prohibited directions.

For example, the list for square 11D would consist of three entries: west, north and east. The list for square 16A would have no entries.

Although topologically equivalent, in most cases this mode probably requires a longer list and therefore larger memory, since probably the number of prohibited directions from each occupiable square most typically exceeds the number of permitted directions. That is, more squares contain cul de sacs or lines passing straight through, as at 11D or 12D, than have three- or four-way intersections as at 13D or 16A.

It is likely, however, that mazes in which the reverse is true can be made up. In particular, mazes in which not only hallway shapes but also broadened-out room shapes are defined might be much more efficient to map in terms of forbidden directions.

A third approach is to store the list of occupiable squares, and with each a list of other squares into which movement is permitted from that square. In this mode, the microprocessor must first determine what grid position would result from movement in the attempted direction; and then permit the movement only if that resulting grid position can be found in the list of permitted target squares.

Here the number of entries for each square is exactly the same as in the first method, but the form of the data is different. For square 11D, for example, the single permissible entry would be "12D" rather than "south".

In principle the data stored in the first approach are not only usable more directly but also more compact—since each of the four compass directions can be stored as a single two-bit value; whereas storing the Cartesian coordinate "(2, D)" for a fifteen-by-fifteen grid requires two four-bit entries—or four times as much data. Depending upon the architecture of the particular processor chip employed, however, the greater efficiency may not be realizable in practice.

In a fourth approach, analogous to the second, the list of occupiable squares is accompanied by, for each, a tabulation of other squares into which movement from that square is prohibited. Here as in the third mode the microprocessor first calculates the grid position that would result from moving in the attempted direction, but then permits that chosen movement if the resulting grid position cannot be found in the list of prohibited target squares.

Once again, the number of entries here is the same as in the second method, but the data form differs: for square 11D, prohibited destinations are 11C, 10D and 11E.

Yet a fifth way to define the maze is to store a map of the maze in the form of straight-hallway-segment termination pairs. For instance, such a list might read 107–137, 131–13D, 13B–14B, 11D–1DD, and so forth, for paths 201, 202, 203, 204, etc. respectively. The microprocessor would then have to employ geometric rules to determine what line segments pass through the player's current position, and then in turn from that information what movements are permissible.

Also possible is a sixth storage mode that is a negative of the fifth mode—namely to store a map of the maze in the form of straight-wall-segment terminations or corners. Such a map would require much more memory for the type of maze illustrated in FIG. 4, but that is only because the paths have all been made just one square wide, while the walls may be several squares wide. The sixth mode might be more efficient, however, for storage of a maze with broad rooms and narrow walls.

Whichever mode is employed, the cost of memory space in the integrated-circuit microprocessor chip is likely to be significant. That is particularly important because we consider it desirable to provide not just one maze but several different mazes in our electronic game, to maintain the challenge and interest of the game as long as possible for its players—particularly advanced players.

Accordingly we prefer to make quadruple use of each maze that is stored. More specifically, we include provision for, in effect, rotating each stored maze pattern in ninety-degree increments so that it seems to be—from each player's perspective—four different apparent mazes. In our preferred embodiment we actually store four different maze patterns, for a total of sixteen apparent mazes.

For this purpose there are various ways of accomplishing the rotation, including, to mention only three: (1) reinterpreting the four directional inputs as entered at the pushbuttons 11 through 14, (2) exchanging stored directions in pairs—for example, south for west, and north for east—in the permitted-direction lists (in the first storage method) to reflect the maze patterns about corner-to-corner diagonals, and (3) interchanging coordinates to, in effect, perform simple matrix rotation of each coordinate value in the maze-defining lists.

Topologists, mathematicians and maze lovers will doubtless be able to describe many other ways of defining a maze for storage in a small, inexpensive microprocessor chip. The point of this lengthy exposition of different definitional modes is twofold:

(1) to guide and enable skilled microprocessor programmers to practice our invention by any of a variety of quite satisfactory methods; and (2) to establish clearly that it is meaningful to speak, in general terms, of memory means simply "defining a maze"; and that it would accordingly be counterproductive to a broad, general expression of our invention to arbitrarily select any of the defining techniques for special status in such a general expression.

We should mention, however, that our preferred embodiment uses the first of the defining techniques described above.

Figure 5:
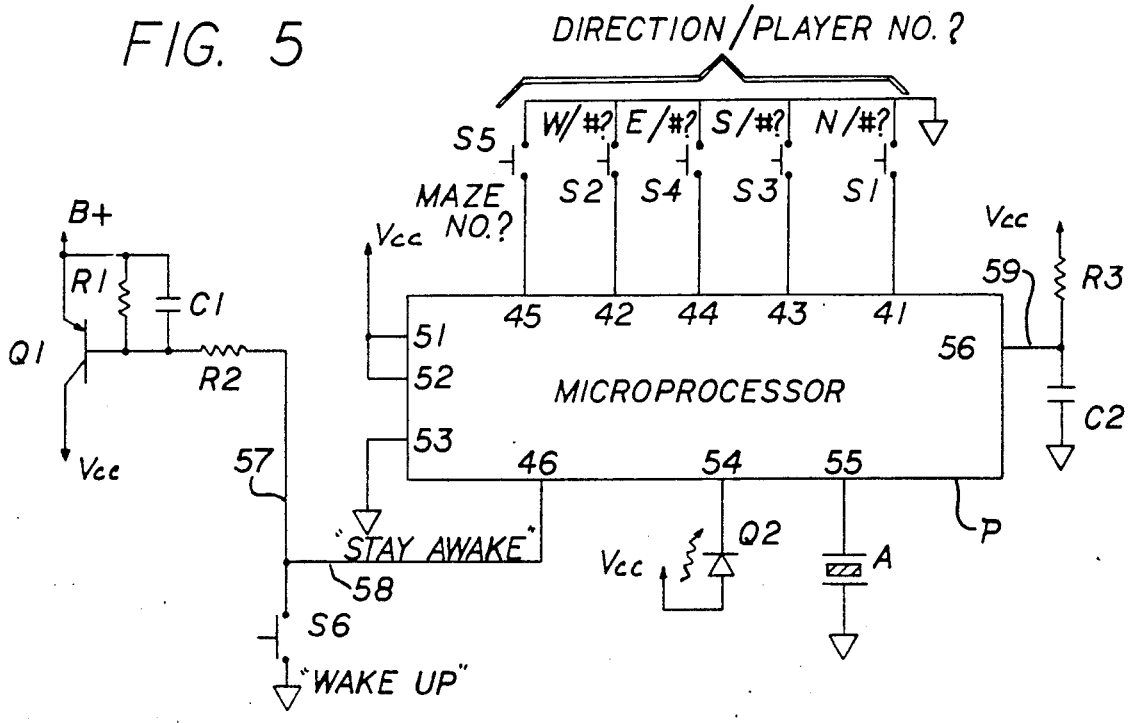
FIG. 5 is an electronic schematic of the electronic device.

The electronic apparatus of our preferred embodiment appears schematically in FIG. 5. The directional-input switches S1 through S4 are used to selectively ground certain respective inputs 41 through 44 of the microprocessor P. (At the players' discretion these switches S1- S4 are also employed to query the apparatus as to which player's turn is up.) The maze-number query switch S5 functions similarly.

The "wake up" switch S6, however, works differently: it biases a power-supply transistor Q1 on, via a grounding line 57—initiating power application from a battery B+to a switched supply bus $V_{cc}$. Power from that bus $V_{cc}$ is applied to two terminals 51 and 52 of the processor P. The processor is also grounded at its terminal 53.

The processor P then latches the power supply on, by internally grounding the processor terminal 46—thereby grounding the bias line 57 via the "stay awake" line 58. The power-supply filter R1-R2-C1 prevents switch-contact bounce in the "wake up" switch S6 from interfering with application of power to the microprocessor P before the latter latches the power on.

If none of the input switches S1 through S6 is closed for a sufficiently long time period (we prefer to program the processor P to select a period of one minute, for our electronic game), the microprocessor releases the "stay awake" line 58. This allows the supply transistor Q1 to drop out—thereby turning off the power, to preserve the battery B+.

Power from the switched bus $V_{cc}$ is also applied to a light-emitting diode Q2 (the above-mentioned signal lamp), which is then controlled at the microprocessor P by either grounding or floating the processor's associated terminal 54. The processor also controls an audio speaker A.

Under control of the processor, the speaker A produces various tones—and the diode Q2 glows—to indicate that certain attempted player moves are permissible, in terms of the constraints imposed by the maze. Similarly the speaker A produces other tones to indicate that particular attempted moves are prohibited. In some special situations numerous tones are sounded in sequence, to produce a semblance of music—as at the start of the game, or when a player wins the game.

Also receiving power from the switched bus $V_{cc}$ is an RC filter consisting of R3 and C2, whose junction point is wired at line 59 to another terminal 56 of the processor. This filter connection controls the speed at which musical tunes are played by the processor P, in conjunction with the audio speaker A.

We prefer to use for the processor P a unit that is commercially available under the component designator "COPS 44L". When this unit is in use, the processor terminals 41 through 44 in FIG. 5 (connected to switches S1 through S4) are respectively ports $L_2$, $L_4$, $L_3$ and $L_5$ of the processor. The processor terminal 45 in FIG. 5 (connected to the "maze number?" switch S5) is processor port $L_1$; the processor terminal 46 (connected to the "stay awake" line 58) is port $L_6$; and the points marked 51 through 56 in FIG. 5 are respectively the processor terminals $V_{cc}$, Reset* (i.e., "Reset-complement"), $V_{gnd}$, $D_0$, $D_1$ and $CK_2$.

In our preferred embodiment, the resistors R1 and R2 are of resistance values 47k and 10k respectively; and capacitor C1 is of capacitance 0.1 microfarad. The musicclock resistor R3 and capacitor C2 can be set as preferred, on a purely esthetic basis, for the desired musical effect.

Figure 6:
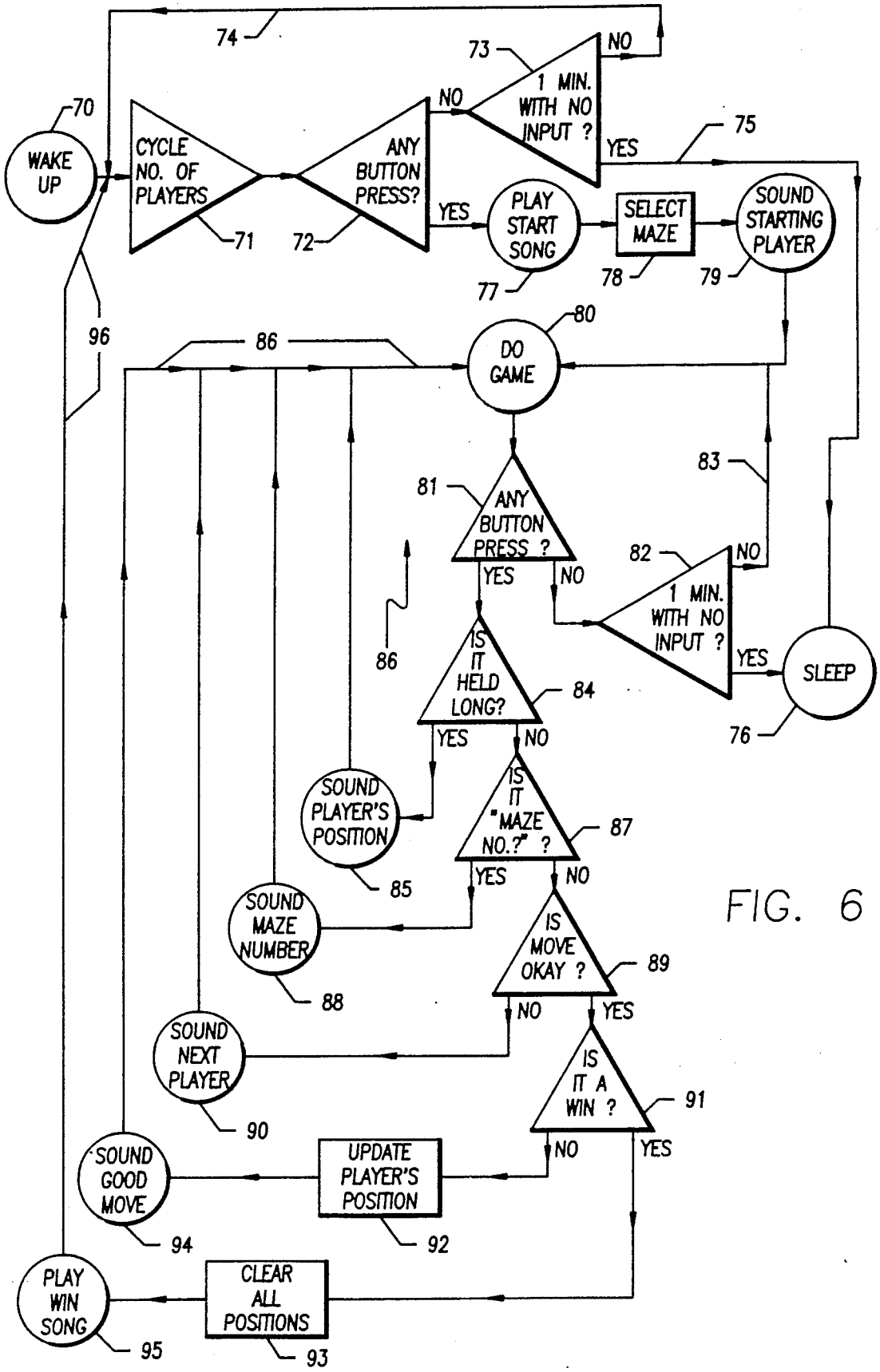
FIG. 6 is a flow diagram of a program for incorporation into a microprocessor that forms part of the electronic device. The program preferably is loaded into the microprocessor in manufacture of the microprocessor.

FIG. 6 represents the flow of the logical processes that are programmed into the microprocessor P. The program begins automatically at the "wake up" block 70. This occurs when the "wake up" button 16 (FIG. 2) is pressed, closing the "wake up" switch S6 (FIG. 5).

The processor then cycles through an interactive loop 71–74, beginning with a function 71 denoted "cycle no. of players", to determine the number of players who will participate in the game. In this function 71, the processor first causes the audio speaker to sound a single short tone, to represent the possibility that there will be only a single player.

The processor then immediately reaches the "any button press?" test 72. If there has been no response from the players (as will usually be true in the first pass through this test 72), the processor leaves that test 72 at its "no" output, reaching the "1 min. with no input?" test 73. Initially this one-minute test clock cannot have run, so the processor leaves this test at "no" and proceeds by a recycle line 74 to reenter the "cycle no. of players" function 71.

This loop 71–74 repeats a preset number of times, as counted in the "cycle no. of players" function 71—or until it is interrupted at the button-press test 72 or the 1-minute clock test 72—whichever of these three possibilities occurs first. The preset number of cycles establishes a response time allowed for normal reply by players.

That time preferably corresponds to an interval of about one-and-a-half to four seconds, as preferred for the intended age group of the players. The "cycle" function 71, taken with the time needed to traverse the loop 71–74, thus serves as a player-normal-response-time clock counter.

If indeed there will be just one player, the player should so indicate by pressing any of the four directional input buttons 11 through 14 (FIG. 2). If the player presses a button promptly, that will be the first event to interrupt the cycle 71–74.

The processor will accordingly leave the "any button press?" test 72 at "yes" and proceed to the "play start song" function 77. If, however, there will be more than one player, the players simply wait.

If there is no player response within the preset number of cycles of the loop 71–74, as measured by running of a counter at the "cycle no. of players" function 71, the device then sounds two short tones in sequence, to represent the possibility of two players. The device then again cycles through the timing loop 71–74, until interrupted as before by one of the three possible events listed above.

It will now be appreciated that the "1 minute with no input?" test cannot be the interrupting event for a query of one, two or three tones. The reason is that the "cycle" function 71 itself interrupts the loop 71–74 after a few seconds at most.

If there are to be two players, they respond by pressing any directional input, and the apparatus will then leave the "any button press?" test 72 at "yes", proceeding to the "play start song" function 77 etc.; if not, the players again simply wait while the player-response counter runs in the "cycle" function 71.

Normally this procedure continues until the device has sounded three and then (in the absence of player response) four tones—and/or until some player response is entered to select the three- or four-player mode of play. If for any reason, however, the players enter no response to any of the tone sequences, the apparatus will continue to circulate through the timing loop 71–74.

Eventually, the processor will cycle through that loop a number of times that corresponds to one minute. This condition will be detected by the running of a counter in the "1 minute" test 73. The processor will then leave that test 73 at "yes", and proceed at 75 to the "sleep" function 76. Here the microprocessor ungrounds its terminal 46 (FIG. 5) as previously described, to let the power-supply latch transistor Q1 drop out, turning off the power to the system bus $V_{cc}$.

Usually, however, before the "1 minute" test counter runs out there is some player response to one of the tone queries, so that the processor can leave the "any button press?" test 72 at "yes" and reach the "play start song" function 77. The processor then by known methods generates a suitable musical fanfare to begin the game, and proceeds to the "select maze" block 78, the "sound starting player" function 79, and then the "do game" junction point 80.

If desired, maze selection actually can occur earlier in the logic flow—for example, it can be made part of the "cycle" function 71. In effect, the maze selection process is controlled at that block 71 anyway, by measurement of the time interval between the "wake up" function 70 and the player pushbutton response in block 71.

That interval is arbitrary, being controlled by the players; they have no realization that the interval is being monitored. When counted in very short time units such as milliseconds, in a recycling register within the processor, this interval is effectively a random number for purposes of selecting the maze. We thus prefer to continuously recycle a four-bit "maze number" register within the processor, until the player response within—for example—the loop 71–74, and allow the resulting contents of the register to directly represent the maze to be used.

Uncorrelated delays in blocks 72, 77, and even 79 can be added to the arbitrarily player-controlled interval without departing from the randomness of this selection process. Hence maze selection can occur at any point between the player-query cycle 71 and the "do game" junction point 80; or various parts of the selection process can be distributed over those steps.

In the "sound starting player" function 79, the device sounds a single tone to invite the first player to proceed, and to direct that player to begin from the "north" starting point for player 1—that is to say, square 107 in FIG. 4. Logic flow then proceeds through the "do" junction 80 to another "any button press?" test 81.

Here as before the processor circulates through a waiting loop 80–83, but this is a simpler one with only two terminating events—player response, or a one-minute clock counter. At each pass through this "any button press?" test 81, if the apparatus has received no player response the apparatus proceeds from the test 81 at "no" to a "1 min. with no input?" test 82.

Here a counter operates to detect the number of passes through this smaller loop 80–83 corresponding to a one-minute interval; if that counter has not run out, the processor leaves the "1 min.?" test 82 at "no" and returns by a recycle line 83 and the "do game" junction 80 to the "any button" test 81. If the minute counter in the "1 min.?" test 82 has run, however, the processor leaves that test 82 at "yes" and proceeds to the "sleep" function 76 as previously described.

In normal play a prompt player response will be detected in the "button press?" test 81. This event will cause the processor to leave that test 81 at "yes", and to proceed to test for two special events, as follows.

In the "is it held long?" test 84, the apparatus watches for the possibility that the player whose turn it is has lost track of position and wants the apparatus to indicate what that player's position is. The player enters this request by holding down any of the directional input buttons 11 through 14 for a relatively long time. For example, the game designer may set the threshold for this interval to three-quarters of a second, or a second and a half, depending upon the target age group for players of the game.

If the button is held down for longer than the threshold interval, the processor leaves the "held long?" test 84 at "yes"; and in the "sound player's position" function 85 reads out that player's coordinates audibly in accordance with the system diagrammed in FIG. 4. More specifically, the device first sounds a series of tones representing the abscissa value, and then after a short pause another series representing the ordinate value. Since "zero" values are not readily interpreted (and in any event the zero rank and file will normally be considered by children as the "first" rank and file, respectively), the processor preferably adds one to both values.

For example, if the player position is square 14C (FIG. 4), the processor will first sound "4+1" short tones—i.e., a total of five tones, representing the fifth rank (counting from the top)—and then after a short pause will sound "C+1" tones. As the value "C" represents twelve in hexadecimal notation, the device will here sound a total of thirteen tones, representing the thirteenth file (counting from the left).

After counting off the player position, the apparatus will return by a recycle path 86 to the "do game" junction 80. It will then again wait for a button press in the loop 80–83.

If the player has not held a button down for a long time, as detected in the "held long?" test 84, the processor leaves that test 84 at "no" and proceeds to test for the second special event mentioned above—in the "is it 'maze no.?'" test 87. If the players wish to know which maze the apparatus is using (that is, which maze the players have unwittingly selected), they can at any time during normal play press the "?" button 15 (FIG. 2), which closes the "maze no.?" switch S5 (FIG. 5).

If this is the button press that caused the apparatus to leave the "button press?" test 81 at "yes", the apparatus will detect this fact at the "maze no.?" test 87—and will accordingly leave that test 87 at "yes". The apparatus will then, in the "sound maze number" function 88, emit a number of tones equal to the maze number; and return via the recycle line 86 to the "do" junction 80.

If the "maze no.?" switch S5 was not pressed, the processor will leave the "maze no.?" test 87 at "no" and proceed to the "is move okay?" test 89. This branch corresponds to the primary normal-play mode of use for the apparatus.

Entry into this branch of the flow chart means that a player has entered an attempted game move into the dedicated digital electronic device P. This event will be recognized as further corresponding to the first step "(a)" of the method of our invention, as previously set forth in the "Summary of the Disclosure" section of this document.

It is at this point that the processor resorts to its maze definition tables discussed at length above—to determine whether the player's attempted move is valid, in terms of the maze as defined. (As mentioned earlier, depending upon the form in which the data are stored the processor here may have to make some preliminary determination of the destination square that results from the direction entry.)

If the attempted move is not valid, the apparatus leaves the "move okay?" test 89 at "no" and in the "sound next player" function 90 emits a number of tones equal to the number of the next player. If desired, the apparatus may also be programmed to first emit a special tone (e.g., a raspberry sound) indicating that the attempted move was invalid.

In this case of an invalid move, the player who entered that move thus loses his turn, and play passes to the next player in sequence. That player, like the first, enters play from the "do" junction 80 and thence the second "any button?" test 81.

If the attempted move is valid, however, the apparatus leaves the "move okay?" test 89 at "yes" and enters the "is it a win?" test 91. If, for the maze shown in FIG. 4, the player's position is 167 and the attempted move is "south", that is a winning move.

If those two conditions are not met, the apparatus will leave the "is it a win?" test 91 at "no", and in the "update player's position" function 92 will revise its record of the player's position in accordance with the directional entry that has been found valid. The apparatus will then proceed to the "sound good move" function 94, where an approving sound is emitted, and pass via the recycle path 86 to the "do game" junction 80.

Thus after a good move the player entering that move is allowed to continue play. That player continues to be rewarded with additional move opportunities, circulating through the loop 80-81-84-87-89-91-92-94-86, until either the player falters by entering an invalid move as detected at the "okay" test 89, or wins the game—or for any reason leaves the loop at any of the intermediate tests 82, 84, 87 as previously discussed.

If the conditions for a winning move are met, however, the apparatus leaves the "win?" test 91 at "yes" and proceeds to the "clear all positions" function 93. Here the player positions are all reset to their respective starting squares 107, 170, 1E7 and 17E. The "play win song" function 95 is next: the device emits a victory tone, or preferably fanfare, and flashes the signal lamp; and then returns via a second recycle path 96 to the "cycle no. of players" function 71.

Thus, whether the attempted move of a particular player is valid or not, and whether the move is a winning move or not, the player receives from the device—in response—clear information as to the validity of the attempted move. Furthermore, the player never receives from the device any other type of information about the maze structure.

In this connection it should be noted that the maze number, which the player can obtain from the device upon inquiry, is not in itself information about maze structure. This is true even though structural information may be derived by combining (i) the maze number revealed by the device with (ii) independently furnished information—for example, paper maps of all the mazes, which can be supplied with the game.

In essence the same is also true of the player's position on the maze, which also can be obtained from the device. This information only relates to one square of the grid, and of course only validates information already possessed by a player who is in the least successful.

Accordingly the player of the game, in listening to the sounds which the device produces, and/or observing coordinated flashes of the signal lamp, is receiving from the device information solely as to validity of the attempted move. This function will be recognized as corresponding to the second step "(b)" of our gameplay method, set forth in the "Summary of the Disclosure" above.

To obtain success in playing this game, the player must then visualize, exclusively by inference from the validity information cumulatively thus received, part of the configuration of the maze. Such visualization is necessary for the player to improve beyond initial random-trial efforts—and corresponds to the third step "(c)" of our method as previously set forth.

Moreover, in circulating through the flow paths of FIG. 6—whether advancing through the successful-play loop 80-81-84-87-89-91-92-94-86 or advancing through an invalid-move loop, as for example 80-81-84-87-89-90-86— the player or players repeat the steps "(a)" through "(c)", in the same order, multiple times to advance through the maze, eventually to a goal. This repetition corresponds to the fourth step "(d)" of our method.

It will further be appreciated now that, as set forth in the statement of our game method, the method has "no step in which the electronic device develops or displays a direct visual representation of any portion of the maze."

In playing the game it is ordinarily important to keep the game device 10—the "electronic compass" as it may be so designated—aligned with the game board 20 as shown in FIG. 3. When players become very advanced they may prefer to dispense with this condition, and indeed with the board 20 entirely; but that may be considered the exception rather than the rule.

By contrast, most players will want not only to keep the "electronic compass" 10 aligned with the board, but also to move their respective playing tokens 31 through 34 carefully in accordance with moves validated by the apparatus. Particularly as beginners, most players will also want to use the path markers 35 to aid in visualization of the portions of the maze already traversed.

From FIG. 4 it may be appreciated that some players may have to use the same paths as other players, to reach the central goal square 177. Not only is there just one path 215 that leads into the goal 177, but there are just three paths 210, 213 and 215 that lead into the central pattern of paths surrounding the goal. (The seemingly most natural approach route for player 4, in particular, leads via path 208 to a cul de sac at square 169.)

Therefore, when there are four players, at least two players must traverse in common one of the three paths 210, 213, 215. Accordingly a great advantage will accrue to any player who is careful to observe and remember the initial attempts, whether or not successful, of other players to leave the medium-distance portion of the pattern—that is, paths 207, 209, 218 and 216.

For this same reason, competitive players will become anxious to improve their power of abstract-space visualization sufficiently to abandon use of the path markers 35, use of the current-position tokens 31 through 34, and eventually even use of the board 20. In these ways the competitive instinct is very strongly invoked by our present game to stimulate and develop the player's abstract spatial-relations sense.

For children having normal sensory capacities, the signal lamp—that is, the light-emitting diode Q2 (FIG. 5)—enhances and augments the game-playing excitement that is provided by audible signals from the audio speaker A. For players whose hearing is impaired, however, the signal lamp is particularly important as it allows such players to both fully enjoy the game and fully make use of the abstract spatial-relations development benefits which it confers.

It will be understood that the foregoing disclosure is intended to be merely exemplary, and not to limit the scope of the invention—which is to be determined by reference to the appended claims.

We claim:

1. A self-contained electronic game for stimulating and developing abstract spatial-relations sense in young children, without requiring verbal or spelling ability or the ability to operate a typewriter-like keyboard; said game comprising:

first dedicated digital electronic memory means defining a maze;

second dedicated digital electronic memory means defining a position in the maze for each player of the game respectively;

manually operable dedicated directional input means for use by a player in entering an attempted move;

dedicated annunciator means for communicating to players whether an attempted move is valid;

dedicated digital electronic processing means, interconnected to receive information from the directional input means and from the first and second memory means, for responding to any attempted move which each player respectively enters at the input means by actuating the annunciator means to communicate whether that move is valid for that player's position in the maze;

the processing means having no functional interconnection with any device for displaying a direct pictorial representation of any portion of the maze;

wherein the directional input means comprise means for receiving direction of the attempted move from a single respective manual motion;

passive pictorial means, having no electronic interconnection with the processing means, for pictorially representing an array of game positions, conceptually corresponding to an abstract array of geometric positions that includes geometric positions constituting the maze; and position-defining means for manual placement in relation to the pictorial means to adid a player in visualizing position in and progress through the game positions.

2. The game of claim 1, wherein:

the passive pictorial means comprise a first set of directional indicia defining orientation in relation to the array of game positions; and the input means comprise a control housing having a second set of directional indicia related to the first set of directional indicia;

whereby the input-means control housing is susceptible to alignment with the passive pictorial means.

3. The game of claim 1, wherein:

the processing means comprise means for advancing each player to a new position in the maze in accordance with that player's attempted move, and in accordance with the defined maze, if that attempted move is a valid move.

4. The game of claim 1, wherein:

the annunciator means generate an exclusively acoustic indication of validity or invalidity of an attempted move.

5. A self-contained electronic game for stimulating and developing abstract spatial-relations sense in young children, without requiring verbal or spelling ability or the ability to operate a typewriter-like keyboard; said game comprising:

first dedicated digital electronic memory means defining a maze;

second dedicated digital electronic memory means defining a position in the maze for each player of the game respectively;

manually operable dedicated directional input means for use by a player in entering an attempted move;

dedicated annunciator means for communicating to players whether an attempted move is valid;

dedicated digital electronic processing means, interconnected to receive information from the directional input means and from the first and second memory means, for responding to any attempted move which each player respectively enters at the input means by actuating the annunciator means to communicate whether that move is valid for that player's position in the maze;

the processing means having no functional interconnection with any device for displaying a direct pictorial representation of any portion of the maze;

wherein the directional input means comprise means for receiving direction of the attempted move from a single respective manual motion;

a passive pictorial game board that defines an array of game positions, conceptually corresponding to an abstract array of geometric positions that includes geometric positions constituting the maze, but is not interconnected with the processing means electronically; and playing tokens for manual placement on the game board to aid a player in visualizing position in and progress through the maze.

6. The game of claim 5, wherein:

the game board comprises a first set of directional indicia defining orientation in relation to the array of game positions; and the input means comprise a control housing having a second set of directional indicia related to the first set of directional indicia;

whereby the input-means control housing is susceptible to alignment with the game board.

7. A self-contained competitive electronic game apparatus for making use of the competitive nature of young children to stimulate and develop abstract spatial-relations sense in such children, without requiring verbal or spelling ability or the ability to operate a typewriter-like keyboard; said game comprising:

first dedicated digital electronic memory means defining a maze;

second dedicated digital electronic memory means defining a position in the maze for each player of the game respectively;

manually operable dedicated directional input means for use by a player in entering an attempted move;

dedicated annunciator means for communicating to players whether an attempted move is valid;

dedicated digital electronic processing means, interconnected to receive information from the directional input means and from the first and second memory means, for responding to any attempted move which each player respectively enters at the input means by actuating the annunciator means to communicate whether that move is valid for that player's position in the maze;

wherein the processing means and the first and second memory means comprise:

means for signalling each of a plurality of players in turn to enter attempted moves, means for keeping of track of how many players are in the game, and means for keeping track of which player's turn it is; and wherein the processing means have no functional interconnection with any device for displaying a direct pictorial representation of any portion of the maze;

passive pictorial means, having no electronic interconnection with the processing means, for pictorially representing an array of game positions, conceptually corresponding to an abstract array of geometric positions that includes geometric positions constituting the maze; and position-defining means for manual placement in relation to the pictorial means to aid a player in (1) visualizing position in and progress through the game positions, and thus in (2) manually creating a pictorial map of part of the maze;

whereby each particular one of a plurality of competing players can selectively either (a) employ the position-defining means to create such a map of part of the maze, at the cost of making the map visible to other players, or (b) not so employ the position-defining means, at the cost of foregoing the advantage of seeing the part of the maze which that particular one player is traversing;

whereby the game apparatus places a great competitive premium on ability to deduce and remember the maze structure without creating a pictorial map, while yet encouraging meaningful participation in the game by players who lack that abillity; and wherein:

the directional input means comprise means for receiving direction of the attempted move from a single respective manual motion;

the processing means comprise means for advancing each player to a new position in the maze in accordance with that player's attempted move, and in accordance with the defined maze, if that attempted move is a valid move;

the annunciator means generate an exclusively acoustic indication of validity or invalidity of an attempted move;

the passive pictorial means comprise a first set of directional indicia defining orientation in relation to the array of game positions; and the input means comprise a control housing having a second set of directional indicia related to the first set of directional indicia;

whereby the input-means control housing is susceptible to alignment with the passive pictorial means.

8. A method for playing a game for stimulating and developing abstract spatial-relations sense in young children, without requiring verbal or spelling ability or the ability to operate a typewriter-like keyboard; said method comprising the steps of:

(a) entering an attempted game move into a dedicated digital electronic device that has a stored digital representation of a maze, and of at least one player position on the maze;

(b) then receiving from the device information solely as to validity of the attempted move;

(c) then visualizing, exclusively by inference from the validity information cumulatively received, part of the configuration of the maze; and (d) repeating steps (a) through (c), in the same order, multiple times to advance through the maze to a goal;

said method having no step in which the electronic device during normal play develops or displays a direct visual representation of any portion of the maze;

wherein the entering step comprises registering only a direction of the attempted game move, by only a single respective manual motion.

9. The method of claim 8, wherein:

the information cumulatively received, at each repetition of the visualizing step, comprises information received in the immediately concluded receiving step, and all previous receiving steps.

10. The method of claim 9, wherein:

the receiving step comprises receiving information emitted by the device in exclusively acoustic form.

11. The method of claim 10, wherein:

the information received in all previous receiving steps comprises information received in response to attempted moves of at least one other player.

12. A method for playing a game for stimulating and developing abstract spatial-relations sense in young children, without requiring verbal or spelling ability or the ability to operate a typewriter-like keyboard; said method comprising the steps of:

(a) entering an attempted game move into a dedicated digital electronic device that has a stored digital representation of a maze, and of at least one player position on the maze;

(b) then receiving from the device information solely as to validity of the attempted move;

(c) then visualizing, exclusively by inference from the validity information cumulatively received, part of the configuration of the maze; and (d) repeating steps (a) through (c), in the same order, multiple times to advance through the maze to a goal;

said method having no step in which the electronic device during normal play develops or displays a direct visual representation of any portion of the maze;

wherein the visualizing step comprises using a passive pictorial game board to manually keep track of the visualized part of the maze configuration;

said board defining a multiplicity of game positions, but not being interconnected with the electronic device electronically to display any direct visual representation of the maze.

13. The method of claim 12, further comprising the step of:

before the first performance of the entering step, aligning indicia on the electronic device with corresponding indicia on the game board.

* * * * *